United States Patent [19]

Salvi

[11] 3,972,182

[45] Aug. 3, 1976

[54] FUEL INJECTION APPARATUS

[75] Inventor: Enrico Salvi, Salem, Mass.

[73] Assignee: General Electric Company, Lynn, Mass.

[22] Filed: Sept. 10, 1973

[21] Appl. No.: 395,606

[52] U.S. Cl. ..... 60/39.74 R; 60/39.32; 239/404; 239/406

[51] Int. Cl.[2] ..... F02C 3/24; F02C 7/22

[58] Field of Search ..... 60/39.74 R, 39.74 B, 60/39.32; 239/400, 403–406

[56] References Cited

UNITED STATES PATENTS

| | | | |
|---|---|---|---|
| 391,865 | 10/1888 | Schutte | 239/404 |
| 1,513,624 | 10/1924 | Parker | 239/404 |
| 1,934,837 | 11/1933 | Zulver | 239/400 X |
| 3,474,970 | 10/1969 | Simmons et al. | 239/404 |
| 3,572,733 | 3/1971 | Howald | 60/39.32 X |
| 3,589,127 | 6/1971 | Kenworthy et al. | 60/39.74 R |
| 3,638,865 | 2/1972 | McEneny et al. | 60/39.74 B |
| 3,684,186 | 8/1972 | Helmrich | 239/403 X |
| 3,703,259 | 11/1972 | Sturgess et al. | 60/39.74 R |
| 3,713,588 | 1/1973 | Sharpe | 60/39.74 B |
| 3,768,250 | 10/1973 | Kawaguchi | 60/39.74 R |
| 3,811,278 | 5/1974 | Taylor et al. | 60/39.74 R |

FOREIGN PATENTS OR APPLICATIONS

| | | | |
|---|---|---|---|
| 534,491 | 10/1955 | Italy | 239/404 |
| 775,668 | 5/1957 | United Kingdom | 239/404 |
| 314,615 | 7/1929 | United Kingdom | 239/404 |
| 15,269 | 7/1905 | United Kingdom | 239/404 |

*Primary Examiner*—Carlton R. Croyle
*Assistant Examiner*—Robert E. Garrett

[57] ABSTRACT

An improved fuel injection apparatus is provided to uniformly disperse a low pressure fuel in a highly atomized manner for introduction into a combustion apparatus. The fuel injection apparatus of this invention employs a central fuel injector which initially swirls and distributes the fuel in a near uniform sheet for receipt within the system of counter-rotating air swirl means.

There is also included a system of counter-rotating air swirl means disposed about a shroud member whereby the primary atomizing forces are the high shear stresses developed at the confluence of the counter-rotating air streams.

10 Claims, 3 Drawing Figures

FUEL INJECTION APPARATUS

The invention herein described was made in the course of or under a contract or subcontract thereunder (or grant) with the Department of the Navy.

CROSS-REFERENCES TO RELATED APPLICATIONS

This application is being filed concurrently with application Ser. No. 395,605 by Barry Weinstein et al., assigned to the instant assignee, which discloses and claims a particular inventive species of the generic invention disclosed and claimed herein.

BACKGROUND OF THE INVENTION

This invention relates to an improved fuel injection apparatus and, more particularly, to an improved fuel injection apparatus for uniformly atomizing and dispersing fuel supplied to a combustion chamber.

Fuel injection into a continuous flow combustion chamber, as, for example, in a gas turbine engine, has posed continuing design problems. Difficulties have been encountered in injecting fuel in a highly dispersed manner so as to achieve complete and efficient combustion of the fuel and at the same time minimize the occurrence of fuel rich pockets which, upon combustion, produce carbon or smoke. Fuel injection difficulties have been further complicated by the recent introduction of gas turbine engines having increased combustor pressure and inlet temperature capabilities requiring low pressure fuel devices. Existing fuel spray atomizer efficiency decreases as combustor pressure is increased, resulting in a more non-uniform dispersion of fuel, together with an increase in the fuel rich zones within the combustion chamber. Such zones cause reduced burner efficiency, excessive exhaust smoke, and a non-uniform heating of the combustor shell, a condition commonly referred to as hot streaking, which can lead to rapid deterioration of the shell.

Increasing the fuel pressure to spray atomizers has been suggested as one possible solution. However, the increased weight of a high pressure pump, together with the increased propensity of leaking the volatile high pressure fuel, imposes such a high risk as to make the use of high pressure pumps unlikely, at least within the immediate future.

Recently suggested atomizers for use with low pressure fuel have employed a system of counter-rotational primary and secondary swirl vanes. Some systems have suggested that a fuel/air mixture be introduced upstream of the swirl vanes, whereupon the fuel becomes uniformly dispersed by the action of the vanes. However, such atomizers have been found on occasion to accumulate carbon between the swirl vanes when the inlet airflow and fuel to the atomizer are heated. Present emphasis has centered on developing a system whereby a flow of fuel is introduced within a system of counter-rotational primary and secondary swirl vanes. The fuel is then efficiently atomized by the high shear forces developed at the confluence of the counter-rotating air streams.

Therefore, it is a primary object of this invention to provide a fuel injection apparatus that will uniformly disperse a low pressure fuel in a highly atomized manner into a combustion apparatus wherein the fuel is injected downstream of any air swirl vanes, thus eliminating the possiblity of carbon accumulation between the swirl vanes.

It is also an object of this invention to uniformly disperse fuel in a partially atomized manner for introduction into a counter-rotating swirl means to improve overall combustion efficiency thereof.

It is a further object of this invention to provide a fuel injection apparatus employing a system of counter-rotating swirl means disposed about a shroud member whereby the primary atomizing forces are the high shear stresses developed at the confluence of the counter-rotating air streams.

It is also an object of this invention to provide a fuel injection apparatus employing a system of counter-rotating swirl means disposed about a shroud member whereby the velocity and uniformity at which the fuel is dispersed within the shroud may be substantially modulated for greater overall atomization efficiency.

SUMMARY OF THE INVENTION

These and other objects and advantages will be more clearly understood from the following detailed description and drawings, all of which are intended to be representative of, rather than in any way limiting on, the scope of invention. The fuel injection apparatus of this invention includes a fuel injector having a cylindrical housing. A tubular body is centrally disposed within the cylindrical housing and spaced apart therefrom so as to define a first annular air passage therebetween. Fuel swirl means are also disposed within the tubular body in order to impart a swirl to an inlet stream of fuel. A plurality of circumferentially spaced apart struts or swirl vanes may be disposed intermediate the tubular body and cylindrical housing. A generally cylindrical primary shroud is coaxially spaced downstream from the fuel injector and defines a central core air passage therethrough. Secondary air swirl means are disposed intermediate the injector and primary shroud to impart a circumferential swirl component to the flow through the core wherein the secondary swirl component is in the same circumferential direction as the fuel swirl. Tertiary air swirl means are disposed downstream of the secondary air swirl means and impart a circumferential swirl component in the direction opposing that of the secondary swirl means such that fuel reaching the downstream end of the primary shroud is atomized by the shear stresses developed by the counter-rotating aerodynamic forces at the confluence of the secondary and tertiary swirls.

BRIEF DESCRIPTION OF THE DRAWINGS

The invention may be better understood upon reading the following description of the preferred embodiment in conjunction with the accompanying drawings.

DESCRIPTION OF THE PREFERRED EMBODIMENT

Figure 1:
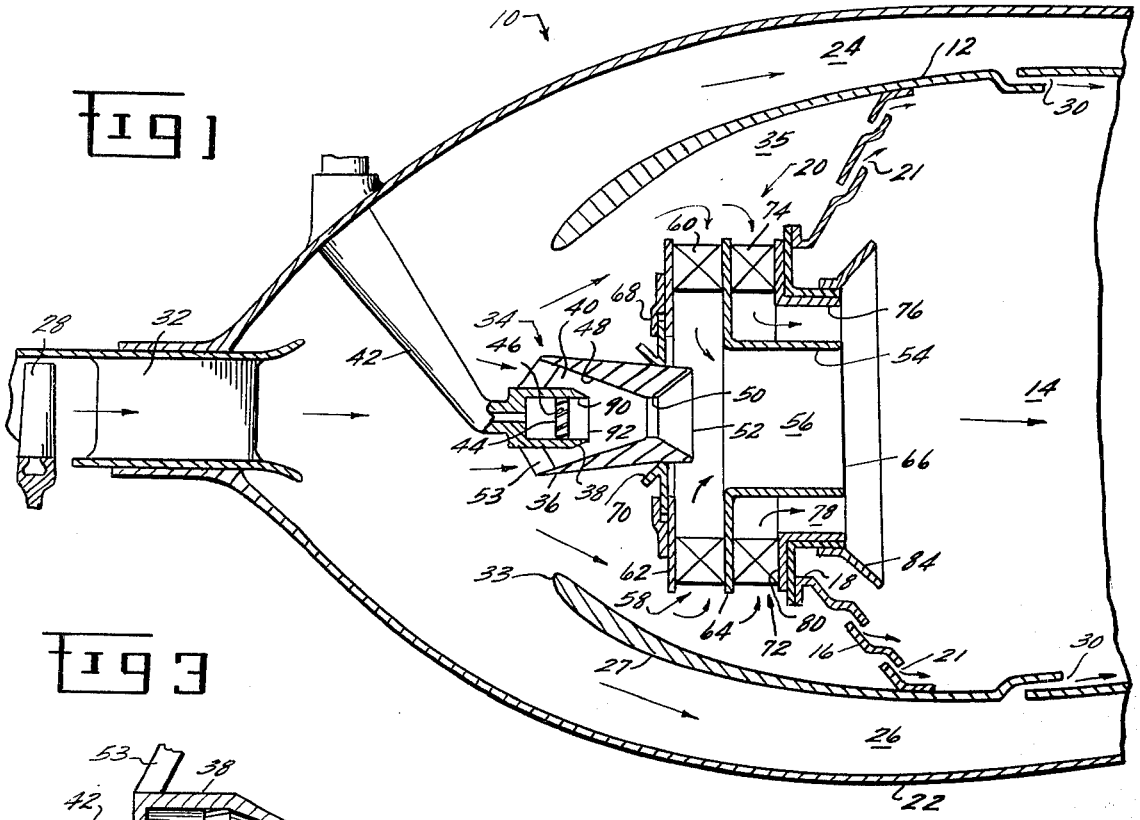
FIG. 1 shows a partial cross-sectional view of a typical combustion chamber of the type suitable for a gas turbine engine and including the fuel injection apparatus of this invention.

Referring now to the drawings, and particularly to FIG. 1, a continuous burning combustion apparatus of the type suitable for use in a gas turbine engine has been shown generally at 10 as comprising a hollow liner 12 defining an annular combustion chamber 14 therein. The hollow liner 12 includes a transverse upstream dome member 16 having a plurality of openings 18, of which only one is shown in the drawing, circumferentially spaced apart about the engine axis. The openings 18 receive the improved fuel injection apparatus of this invention, one of which is shown generally at 20. The upstream dome member 16, together with the fuel injection apparatus 20, define the upstream end of the combustion chamber 14 with the dome member 16 suitably secured to the hollow body 12. The transverse upstream dome 16 may also include a plurality of apertures or louvers 21 therethrough. As will be understood by those skilled in the art, the combustion chamber 14 may also be of the cannular type.

An outer shell 22 is provided around the hollow liner 12 and in cooperation with the hollow liner, together with an upstream extension 27 thereof, define outer and inner passages 24 and 26 respectively. As will be understood by those of ordinary skill in the gas turbine art, the passages 24 and 26 are adapted to deliver a flow of pressurized air from a suitable source, such as a compressor 28, into the combustion chamber 14 through suitable apertures or louvers 30. The pressurized air is delivered from the compressor 28 through a plurality of circumferentially spaced apart outlet guide vanes 32 whereupon the air is diffused and divided between the outer and inner passages 24 and 26. The upstream extension 27 of the hollow body 12 is adapted to function as a flow splitter dividing the pressurized air delivered from the compressor 28 between the passages 24, 26, and an upstream end opening 33 of the extension 27. The opening 33 communicates with a chamber 35 which is defined internally of the extension 27 and the dome member 16. Pressurized airflow entering the combustion chamber 14 through the louvers 30 operates to cool the hollow liner 12 and dilute the gaseous products of combustion, as is well known in the art.

Figure 3:
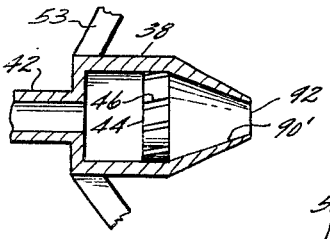
FIG. 3 is an enlarged cross-sectional view of an alternate embodiment of a portion of the fuel injection apparatus of FIG. 1.
Figure 2:
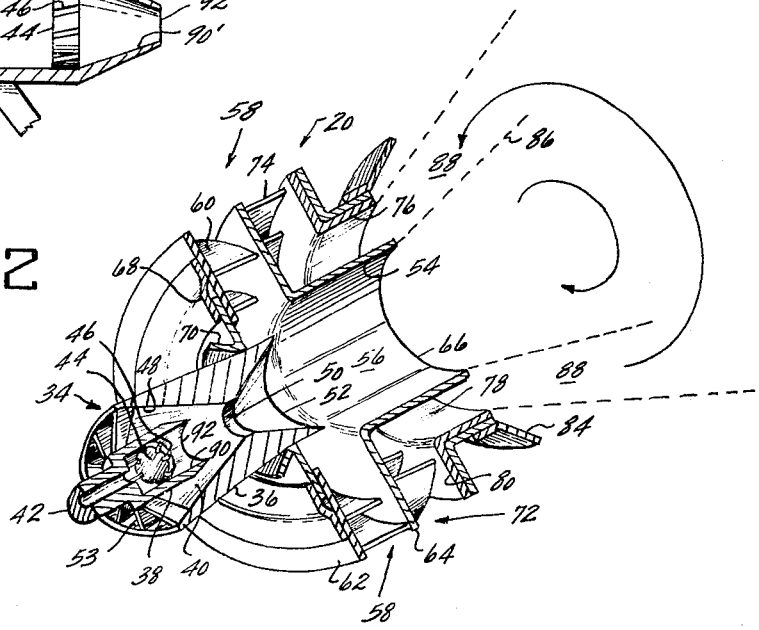
FIG. 2 is an enlarged cross-sectional view in perspective of the fuel injection apparatus shown in FIG. 1.

Referring now to FIG. 2, in conjunction with FIG. 1, the improved fuel injection apparatus of this invention is shown generally at 20 as including a fuel injector 34 having a cylindrical housing 36 with a tubular body 38 centrally disposed therein so as to define an annular air passage 40 therebetween for the admission of a primary airflow. The upstream end of the tubular body 38 connects to a fuel delivery conduit 42 for receipt of an inlet flow of fuel. Centrally disposed within the tubular body 38 is a swirl member 44 which includes at least one slot 46 disposed at an angle to the center axis of the tubular body. The tubular body 38 extends downstream of the swirl member 44 defining an interior cylindrical surface 90 which terminates in a downstream transverse edge 92. Alternatively the interior surface of the tubular body 38 could be conical as shown at 90′ in FIG. 3. The interior surface 48 of the cylindrical housing 36 initially converges to a minimum diameter orifice at 50 and thereafter diverges outwardly, terminating in a sharp transverse edge 52 so as to generally define a venturi.

The annular air passage 40 includes a plurality of circumferentially spaced apart struts 53 disposed intermediate the tubular body 38 and the cylindrical housing 36 at the inlet to the air passage 40. It is preferred that the inner and outer surfaces of the annular air passage 40 converge conically inward to define a minimum annular cross-sectional discharge area adjacent the edge 92. As is readily apparent, the axial position of the transverse edge 92 may be adjusted within the venturi depending upon the requirements of a particular combustor. In addition, the struts 53 may be replaced with a plurality of swirl vanes so as to impart a swirl component to the primary airflow through the annular air passage 40 in the same circumferential direction as that imparted by the fuel swirl member 44.

A generally cylindrical primary shroud member 54 is coaxially spaced downstream of the fuel injector 34 so as to define a central core air passage 56 therethrough. Secondary air swirl means shown generally at 58 are provided by a plurality of circumferentially spaced swirl vanes 60. the swirl vanes 60 are maintained in circumferentially spaced relation by disposition between a first radially extending circumferential wall member 62 and a second radially extending circumferential wall member 64 which may be formed integral with the upstream end of the primary shroud 54.

The fuel injector 34 may be retained relative to the first circumferential wall member 62 by a floating ferrule 70 which slidingly engages an annular seal 68 maintained in general concentric relation to the cylindrical housing 36 by an interference fit. The floating ferrule 70 accommodates both limited axial and radial movement of the fuel injector 34 with respect to the first circumferential wall member 62 upon thermal expansion. The floating ferrule 70 is conical shaped in order to facilitate insertion of the fuel injector 34 therein.

The secondary air swirl means 58 imparts a swirl component to the radial inflow of air from the compressor 28 wherein the air swirl is in the same circumferential direction as that imparted by the fuel swirl member 44. Air from the secondary swirl means 58 is injected radially inward relative to the central core air passage 56 and enhances the centrifuging of the fuel/air mixture emanating from the fuel injector 34. The primary shroud 54 terminates at its downstream end in a generally transverse circumferential edge 66 so as to define the core outlet.

Tertiary air swirl means 72 are provided by a plurality of circumferentially spaced swirl vanes 74 in order to impart a counter-rotating swirl to the radial inflow of air from the compressor 28. The airflow emanating from the tertiary swirl means is in a circumferential direction opposing the airflow from the secondary swirl means. A generally cylindrical tertiary shroud 76 of larger diameter than the primary shroud 54 circumscribes the primary shroud in general coaxial alignment therewith so as to define an annular secondary passage 78. The swirl vanes 74 are maintained in circumferentially spaced relation by disposition between the second circumferential wall member 64 and a third radially extending circumferential wall member 80 formed integral with the upstream end of the secondary shroud 76. The downstream edge of the cylindrical tertiary shroud 76 may be attached to an outwardly flared cone member 84.

In operation, liquid fuel, which need not be highly pressurized, is delivered to the fuel injector 34 through the fuel delivery conduit 42. Fuel entering the tubular body 38 is swirled in a clockwise direction by the swirl member 44 as referenced from a point upstream of the fuel injector 34. The swirling fuel leaving the swirl member 44 is ejected onto the extending interior surface 90 from whence the fuel exits from the tubular body 38 at the transverse edge 92 in the form of a near uniform sheet. The swirling fuel sheet is thereafter accelerated and broken down into uniform fuel droplets by the venturi action of the cylindrical housing, together with the pressure drop incurred across the combustor dome. Fuel reaching the circumferential edge 52 is sheared therefrom and accelerated within the core air passage 56 by the co-action of the vortical flows emanating from the fuel injector and secondary swirl means.

Although the exact dispersion of fuel within the core air passage 56 is very often difficult to predict with great precision, it is believed that a greater portion of the liquid fuel sheared from the circumferential edge 52 is centrifuged radially outward by the co-action of the vortical flows emanating from the fuel injector and secondary swirl means into direct impingement on the interior surface of the primary shroud 54. A portion of the impinging fuel forms a swirling film of liquid fuel on the interior surface of the primary shroud and travels axially downstream in the direction of the transverse circumferential edge 66 of the primary shroud 54. The remaining portion of the fuel travels downstream in a highly atomized form through the core air passage 56.

A tertiary counter-rotating vortical airflow emanates from the tertiary swirl vanes 74 in a counter-clockwise direction as also referenced from a point upstream of the fuel injection apparatus 20. The film of fuel reaching the transverse circumferential edge 66 of the primary shroud 54 is highly atomized by the high aerodynamic shear stresses developed at the confluence of the counter-rotating vortical airflows. A conical area of turbulent airflow exists on the boundary shown generally by the phantom line 86 between the counter-rotating vortical airflows and acts to even further disperse the atomized fuel droplets. It should be readily appreciated that the above described clockwise and counter-clockwise directions have been only arbitrarily established and could be respectively reversed.

It is believed that the majority of atomized fuel droplets are centrifuged into the outer vortical flow shown generally at 88 from where they are driven generally outward toward the hollow liner 12. The high differential velocity component between the counter-rotating vortical flows permits a high relative velocity component for the fuel droplets without having to accelerate the fuel droplets to such a high absolute velocity. As will be understood by those skilled in the art, a suitable igniter, not shown, is provided within the combustion chamber 14 to provide initial ignition of the combustible air/fuel mixture discharged from the fuel injection apparatus 20. The core of the vortical flow discharged from the fuel injection apparatus 20 remains at a reduced pressure, thereby entraining a portion of the hot products of combustion so as to cause a recirculation thereof and maintain continuous ignition within the combustion chamber 14. It is also believed that the overall improved atomization of fuel by the fuel injection apparatus of this invention is partly attributable to the increased atomization and uniformity of the fuel dispersed from the fuel injector into the core air passage 56.

Accordingly, while a preferred embodiment of the present invention has been depicted and described, it will be appreciated by those skilled in the art that many modifications, substitutions and changes may be made thereto without departing from the invention's fundamental theme.

What is claimed is:

1. A fuel injection apparatus comprising:

a fuel injector having a cylindrical housing, a tubular body centrally disposed within the cylindrical housing and spaced apart therefrom so as to define a first annular air passage therebetween, fuel swirl means disposed within the tubular body for imparting a swirl to an inlet stream of fuel, and a plurality of circumferentially spaced apart struts disposed intermediate the tubular body and cylindrical housing;

a primary shroud generally coaxially spaced downstream from the fuel injector defining a central core air passage therethrough;

secondary air swirl means disposed intermediate the injector and primary shroud to impart a circumferential swirl component to the flow through the core wherein the secondary swirl component is in the same circumferential direction as the fuel swirl;

tertiary air swirl means disposed downstream of the secondary swirl means to impart a circumferential swirl component in the direction opposing that of the secondary swirl means, such that fuel reaching the downstream end of the primary shroud is atomized by the shear stresses developed by the counter-rotating aerodynamic forces at the confluence of the secondary and tertiary swirls; and wherein the interior surface of the cylindrical housing downstream from the tubular body converges to a minimum diameter orifice and thereafter diverges outwardly, terminating in a transverse edge upstream of the primary shroud so as to generally define a venturi whereby fuel may be sheared from the transverse edge by the coaction of air flowing through the central core air passage and the vortical flow emanating from the secondary air swirl means into direct impingement on the interior surface of the primary shroud.

2. The fuel injection apparatus of claim 1 wherein the struts define swirl vanes for imparting a circumferential swirl component to the airflow therethrough in the same circumferential direction as the fuel swirl.

3. The fuel injection apparatus of claim 2 wherein:

the interior surface of the tubular body extends downstream from the fuel swirl means.

4. The fuel injection apparatus of claim 3 wherein the inner and outer surfaces of the first annular air passage converge conically inward to a minimum cross-sectonal area annular outlet adjacent the downstream edge of the tubular body.

5. The fuel injection apparatus of claim 3 wherein:

the fuel swirl means includes a fuel swirl member centrally disposed within the tubular body with at least one slot through the swirl member at an angle to the axis of the tubular body.

6. The fuel injecton apparatus of claim 3 wherein:

the secondary air swirl means includes a second plurality of circumferentially spaced swirl vanes disposed intermediate a first radially extending circumferential wall member generally concentric to the fuel injector and a second axially spaced apart radially extending circumferential wall member connected to the primary shroud;

and the tertiary air swirl means includes a third plurality of circumferentially spaced swirl vanes disposed intermediate the second wall member and a third axially spaced apart radially extending circumferential wall member.

7. The fuel injection apparatus of claim 6 including a generally cylindrical tertiary shroud of larger diameter than the primary shroud circumscribing the primary shroud in general coaxial alignment therewith so as to define an annular secondary passage in flow communication for receipt of the tertiary swirl.

8. The fuel injection apparatus of claim 6 including a floating ferrule interconnecting the fuel injector with the first radially extending circumferential wall member thus accommodating both limited radial and axial movement of the fuel injector with respect to the first circumferential wall member with thermal growth.

9. The fuel injection apparatus of claim 4 wherein the interior surface of the tubular body extending downstream of the fuel swirl member generally defines a cylindrical surface.

10. The fuel injecton apparatus of claim 4 wherein the interior surface of the tubular body extending downstream of the fuel swirl member generally defines a conical surface.

* * * * *